US009427019B2

(12) United States Patent
Atchley et al.

(10) Patent No.: US 9,427,019 B2
(45) **Date of Patent: *Aug. 30, 2016**

(54) SMOKELESS TOBACCO ARTICLES

(71) Applicant: U.S. Smokeless Tobacco Company LLC, Richmond, VA (US)

(72) Inventors: Frank Scott Atchley, Midlothian, VA (US); James Arthur Strickland, Richmond, VA (US); James M. Rossman, Tampa, FL (US)

(73) Assignee: U.S. Smokeless Tobacco Company LLC, Richmond, VA (US)

( * ) Notice: Subject to any disclaimer, the term of this patent is extended or adjusted under 35 U.S.C. 154(b) by 83 days.

This patent is subject to a terminal disclaimer.

(21) Appl. No.: 13/784,461

(22) Filed: Mar. 4, 2013

(65) Prior Publication Data

US 2013/0220348 A1 Aug. 29, 2013

Related U.S. Application Data

(63) Continuation of application No. 12/649,789, filed on Dec. 30, 2009, now Pat. No. 8,387,623, which is a continuation-in-part of application No. 11/626,176, filed on Jan. 23, 2007, now Pat. No. 7,819,124.

(60) Provisional application No. 60/764,108, filed on Jan. 31, 2006, provisional application No. 61/141,968, filed on Dec. 31, 2008.

(51) Int. Cl.

| | |
|---|---|
| ***A24D 1/14*** | (2006.01) |
| ***A24B 15/18*** | (2006.01) |
| ***A24B 13/00*** | (2006.01) |
| ***A24F 47/00*** | (2006.01) |

(52) U.S. Cl.
CPC ..... *A24B 15/18* (2013.01); *A24B 13/00* (2013.01); *A24F 47/002* (2013.01)

(58) Field of Classification Search
None
See application file for complete search history.

(56) References Cited

U.S. PATENT DOCUMENTS

| | | | | |
|---|---|---|---|---|
| 3,696,179 | A | 10/1972 | Jacobs | |
| 3,757,798 | A | 9/1973 | Lambert | |
| 4,083,372 | A | 4/1978 | Boden | |
| 4,270,552 | A | 6/1981 | Jenkins et al. | |
| 4,284,089 | A | 8/1981 | Ray | |
| 4,306,033 | A | 12/1981 | Morita et al. | |
| 4,375,441 | A | 3/1983 | Adams et al. | |
| 4,393,884 | A | 7/1983 | Jacobs | |
| 4,460,530 | A * | 7/1984 | Hanson et al. | 264/121 |
| 4,624,269 | A | 11/1986 | Story et al. | |
| 4,664,683 | A | 5/1987 | Degen et al. | |
| 4,765,348 | A | 8/1988 | Honeycutt | |
| 4,800,903 | A | 1/1989 | Ray et al. | |

(Continued)

FOREIGN PATENT DOCUMENTS

| | | |
|---|---|---|
| EP | 0 339 658 | 11/2009 |
| WO | WO 99/25355 | 5/1999 |

(Continued)

*Primary Examiner* — Richard Crispino
*Assistant Examiner* — Phu Nguyen
(74) *Attorney, Agent, or Firm* — Fish & Richardson P.C.

(57) ABSTRACT

Tobacco articles having tobacco disposed in a porous matrix. The tobacco articles can provide tobacco to an adult consumer in the form of particles, liquid, or vapor so as to furnish tobacco satisfaction to the consumer. The tobacco can be integrally molded with a plastic material so that at least a portion of the tobacco is disposed in pores of the matrix.

14 Claims, 8 Drawing Sheets

(56) References Cited

U.S. PATENT DOCUMENTS

| | | | | |
|---|---|---|---|---|
| 4,805,767 | A | 2/1989 | Newman | |
| 4,813,437 | A | 3/1989 | Ray | |
| 4,827,949 | A | 5/1989 | Sunas | |
| 4,832,059 | A * | 5/1989 | Garrard et al. | 131/276 |
| 4,917,120 | A | 4/1990 | Hill | |
| 4,972,855 | A | 11/1990 | Kuriyama et al. | |
| 5,092,352 | A | 3/1992 | Sprinkle et al. | |
| 5,101,838 | A | 4/1992 | Schwartz et al. | |
| 5,159,942 | A | 11/1992 | Brinkley et al. | |
| 5,167,242 | A | 12/1992 | Turner et al. | |
| D335,934 | S | 5/1993 | Howard | |
| 5,268,209 | A | 12/1993 | Hunt et al. | |
| 5,372,149 | A | 12/1994 | Roth et al. | |
| 5,400,808 | A | 3/1995 | Turner et al. | |
| 5,441,060 | A | 8/1995 | Rose et al. | |
| 5,597,589 | A | 1/1997 | Deckard | |
| 5,687,746 | A | 11/1997 | Rose et al. | |
| 5,746,227 | A | 5/1998 | Rose et al. | |
| 5,843,851 | A | 12/1998 | Cochran | |
| 5,875,786 | A | 3/1999 | Chase | |
| 5,911,224 | A | 6/1999 | Berger | |
| 5,996,589 | A | 12/1999 | St. Charles | |
| 6,024,012 | A | 2/2000 | Luzenberg, Jr. | |
| 6,053,175 | A | 4/2000 | D'Angelo | |
| 6,098,632 | A | 8/2000 | Turner et al. | |
| 6,102,036 | A | 8/2000 | Slutsky et al. | |
| 6,234,169 | B1 | 5/2001 | Bulbrook et al. | |
| 6,360,477 | B1 | 3/2002 | Flashinski et al. | |
| 6,541,055 | B1 | 4/2003 | Luzenberg | |
| 6,606,998 | B1 | 8/2003 | Gold | |
| 6,617,546 | B2 | 9/2003 | Manetsberger et al. | |
| 6,651,848 | B1 | 11/2003 | Redmond | |
| 6,769,436 | B2 | 8/2004 | Horian | |
| 6,790,496 | B1 | 9/2004 | Levander et al. | |
| 6,796,436 | B2 | 9/2004 | Carson et al. | |
| 6,797,105 | B1 | 9/2004 | Schumann et al. | |
| 6,984,671 | B2 | 1/2006 | Johnson et al. | |
| 7,819,124 | B2 | 10/2010 | Strickland et al. | |
| 7,913,699 | B2 | 3/2011 | Strickland et al. | |
| 7,918,231 | B2 | 4/2011 | Strickland et al. | |
| 8,387,623 | B2 | 3/2013 | Atchley et al. | |
| 8,627,826 | B2 | 1/2014 | Strickland et al. | |
| 8,627,827 | B2 | 1/2014 | Strickland et al. | |
| 2003/0070687 | A1 | 4/2003 | Atchley et al. | |
| 2003/0094182 | A1 | 5/2003 | Atchley et al. | |
| 2003/0168375 | A1 | 9/2003 | Jarvis et al. | |
| 2004/0055613 | A1 | 3/2004 | Horian | |
| 2004/0118421 | A1 | 6/2004 | Hodin et al. | |
| 2004/0118422 | A1 | 6/2004 | Lundin et al. | |
| 2005/0115580 | A1 | 6/2005 | Quinter et al. | |
| 2005/0178398 | A1 | 8/2005 | Breslin et al. | |
| 2005/0244521 | A1 * | 11/2005 | Strickland et al. | 424/751 |
| 2006/0037623 | A1 | 2/2006 | Lawrence, Jr. | |
| 2007/0186943 | A1 | 8/2007 | Strickland et al. | |
| 2007/0186944 | A1 | 8/2007 | Strickland et al. | |
| 2008/0021072 | A1 | 1/2008 | Luzenberg | |
| 2008/0209586 | A1 | 8/2008 | Nielsen et al. | |
| 2008/0210249 | A1 | 9/2008 | Luzenberg | |
| 2009/0126746 | A1 | 5/2009 | Strickland et al. | |
| 2010/0170522 | A1 | 7/2010 | Sun et al. | |
| 2014/0123988 | A1 | 5/2014 | Strickland et al. | |

FOREIGN PATENT DOCUMENTS

| | | |
|---|---|---|
| WO | WO 00/10795 | 3/2000 |
| WO | WO 00/44559 | 8/2000 |
| WO | WO 00/64779 | 11/2000 |
| WO | WO 02/36708 | 5/2002 |
| WO | WO 2004/098324 | 11/2004 |
| WO | WO 2008/013733 | 1/2008 |
| WO | WO 2008/059375 | 5/2008 |
| WO | WO 2008/121403 | 10/2008 |
| WO | WO 2009/010176 | 1/2009 |

* cited by examiner

SMOKELESS TOBACCO ARTICLES

CROSS-REFERENCE TO RELATED APPLICATIONS

This application is a continuation of and claims benefit to U.S. application Ser. No. 12/649,789, filed on Dec. 30, 2009, which is a continuation-in-part application of and claims priority to U.S. application Ser. No. 11/626,176, filed on Jan. 23, 2007, which claims priority to U.S. provisional application Ser. No. 60/764,108 filed on Jan. 31, 2006 by Strickland et al. and entitled "Tobacco Articles and Methods," the contents of which are incorporated herein by reference. This application also claims priority to U.S. provisional application Ser. No. 61/141,968 filed on Dec. 31, 2008 by Atchley et al. and entitled "Smokeless Tobacco Articles," the contents of which are incorporated herein by reference.

TECHNICAL FIELD

This document relates to tobacco products and methods for making smokeless tobacco products.

BACKGROUND

Smokeless tobacco products are consumed without subjecting them to combustion. Such products are manufactured in a variety of forms, including chewing tobacco, dry snuff, and moist snuff. These types of products typically are made using one or more of the following steps: cutting or grinding the tobacco into a particular size, dipping or spraying the tobacco with a casing solution, partially drying the tobacco, storing the tobacco in containers for a period of time, and packaging the tobacco.

An adult consumer who chooses to use a smokeless tobacco product selects the product according to their individual preferences, such as flavor, cut of tobacco, form, ease of use, and packaging.

SUMMARY

This document is based on the discovery that tobacco (e.g., tobacco powder or flakes) can be combined with plastic particles and then heated (e.g., in a sintering process) to generate a plastic product containing tobacco dispersed therein. The product can be permeable, such that when a consumer (e.g., an adult consumer) places the product in his or her mouth, tobacco, tobacco flavor, and other components are released. The tobacco products provided herein can be less expensive to manufacture than traditional smokeless tobacco pouch products, and also can have a longer shelf life. Further, combining tobacco with plastic particles prior to heating can provide tobacco articles with enhanced characteristics (e.g., "roasted" or "toasted" flavors) upon heating.

In one aspect, this document features a tobacco article comprising a porous matrix having a network of pores disposed therein; and tobacco disposed in the pores of the porous matrix, so that when a fluid is passed through the porous matrix, at least one of noncombusted tobacco or a noncombusted tobacco component is introduced into the fluid, wherein the tobacco is integrally molded with the porous matrix. The tobacco can be integrally molded with the porous matrix during a plastic sintering process. The porous matrix can comprise particles of a thermoplastic polymer (e.g., ultra-high molecular weight polyethylene). The thermoplastic polymer particles can have an average diameter between about 10 microns and about 100 microns, or between about 10 microns and about 20 microns. The tobacco article can comprise a ratio of tobacco to polymer of 30:70 to 50:50 by weight. The tobacco can comprise at least one of shredded tobacco, cut tobacco, granulated tobacco, or powdered tobacco. The tobacco can comprise granulated or powdered tobacco particles having an average diameter between about 20 microns and about 100 microns, or between about 40 microns and about 60 microns. The tobacco article can further comprise one or more flavor components. The tobacco article can be adapted to be wholly received by an adult consumer. The tobacco article can have a shelf life of at least 30 weeks. In some embodiments, the article has a central portion having a first average pore size and a peripheral portion having a second average pore size, the first average pore size being larger than the second average pore size.

In another aspect, this document features a method for making a tobacco article, comprising combining thermoplastic polymer particles with tobacco particles, and processing the combination with heat such that the thermoplastic polymer forms a porous matrix having a network of pores disposed therein, with the tobacco particles disposed in the pores of the porous matrix. The processing can comprise sintering. The thermoplastic polymer can be ultra-high molecular weight polyethylene. The thermoplastic polymer particles can have an average diameter between about 10 microns and about 100 microns, or between about 10 microns and about 20 microns. The tobacco article can comprise a ratio of tobacco particles to thermoplastic polymer particles of 30:70 to 50:50 by weight. The tobacco particles can comprise at least one of shredded tobacco, cut tobacco, granulated tobacco, or powdered tobacco. The granulated or powdered tobacco can have an average diameter between about 20 microns and about 100 microns, or between about 40 microns and about 60 microns. The method can further comprise adding one or more flavor components to the tobacco article. The one or more flavor components can be added to said tobacco article after processing with heat. The tobacco article can be adapted to be wholly received by an adult consumer. The tobacco article can have a shelf life of at least 30 weeks.

Unless otherwise defined, all technical and scientific terms used herein have the same meaning as commonly understood by one of ordinary skill in the art to which this invention pertains. Although methods and materials similar or equivalent to those described herein can be used to achieve one or more of the embodiments disclosed herein, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
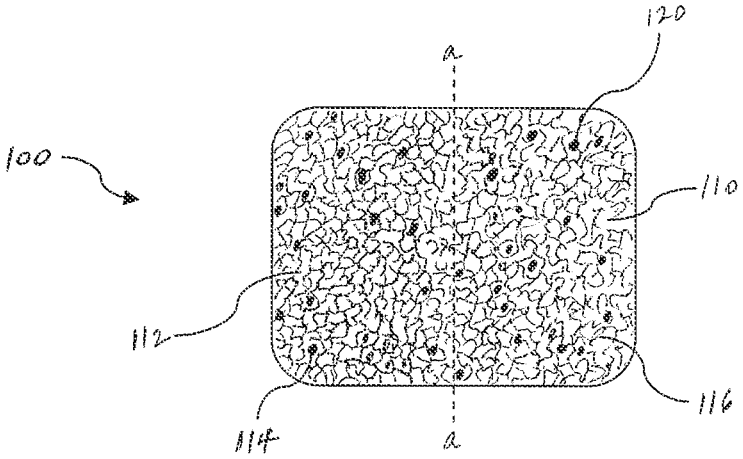
FIG. 1 is a top cross-sectional view of a tobacco article according to some embodiments.

This document provides materials and methods for making smokeless tobacco articles in which a combination of tobacco particles and plastic polymer particles are combined and heated (e.g., in a process such as sintering) to form a product. Methods for making such articles also are provided. Combining tobacco and polymer particles and then heating them (e.g., by sintering) can provide a tobacco article with a pleasing flavor. Such articles also can be less expensive to manufacture than traditional pouch tobacco articles, and can have a longer shelf life because they are substantially dry, rather than wet or moist. For example, a tobacco article as provided herein can have an extended shelf life (e.g., 30 weeks or more) as compared to other smokeless tobacco products.

The tobacco articles provided herein can comprise a porous matrix formed from particles of a plastic polymer (e.g., a thermoplastic polymer), and tobacco dispersed within the pores of the porous matrix. The tobacco article can also include air spaces between the polymer and the tobacco. Typically, the entire article is porous, such that all exterior surfaces have pores that are in fluid communication with pores within the interior of the article, even while the tobacco is contained within the porous matrix. In some embodiments, however, only some of the exterior surfaces of the article are porous. The porous matrix can be formed in a manner to control the average pore size, pore volume, or both. For example, a porous matrix can be formed using a plastic sintering process in which granules of a polymer material are subjected to a controlled heating process for a regulated period of time, temperature, and cycle number as described further below. The size of the polymer particles can affect the size of the pores that result from a sintering process, such that larger particles typically result in larger pores, and smaller particles result in smaller pores. Larger pores can result in faster desorption of tobacco and tobacco components from an article, while smaller pores can result in slower desorption. The rate of tobacco desorption thus can be moderated based on the pore size. Various sizes of polymer particles can be used. For example, the tobacco articles provided herein can be made from polymer particles having an average diameter of about 10 microns to about 100 microns (e.g., about 10 microns, about 20 microns, about 30 microns, about 40 microns, about 50 microns, about 60 microns, about 70 microns, about 80 microns, about 90 microns, or about 100 microns), or any range in between, including, without limitation, about 10 microns to about 20 microns, about 15 microns to about 25 microns, about 20 microns to about 30 microns, about 30 microns to about 40 microns, about 40 microns to about 50 microns, about 50 microns to about 60 microns, about 60 microns to about 80 microns, or about 80 microns to about 100 microns. The resulting sintered article can have average void diameters of about 1 to about 50 microns, or any range in between, including, without limitation, about 1 microns to about 5 microns, about 3 microns to about 15 microns, about 10 microns to about 20 microns, about 20 microns to about 30 microns, about 30 microns to about 40 microns, or about 40 microns to about 50 microns. The resulting article can also have different regions with different average pore sizes. For example, the resulting article can have a gradient of average pore sizes from a surface having a smaller average pores size to an central portion having a larger average pore size. Average pore sizes can be measured by taking a cross-section of the article and measuring, with a microscope, the largest dimension of each observable pore between sintered polymer particles and averaging the observed largest dimensions. The resulting void volume can also depend upon the dimensions of the sintered polymer particles. In some embodiments, the resulting article can also have different regions having different void volumes. For example, the resulting article can have a gradient of void volume from a surface having a smaller void volume to an central portion having a larger void volume.

The polymer particles can include regularly and irregularly sized and shaped particles. In some embodiments, the polymer particles can be substantially spherical (e.g., round beads). In other embodiments, irregularly shaped polymer granules of various sizes can be used. In still other embodiments, the polymer particles can include flakes, cylindrical beads, films with different cut lengths, polymer shavings, chunks, and polymer fibers cut to various lengths. The shape of the polymer particles can impact the average pore sizes, the pore size distribution, and the void volume.

A number of materials are suitable for the porous matrix of a tobacco article as described herein. For example, a porous matrix can comprise a porous, sinterable, insoluble thermoplastic such as polyethylene. Ultra-high molecular weight polyethylene can be particularly useful because, for example, the particle size of ultra-high molecular weight polyethylene beads can be readily controlled. In addition, the use of ultra-high molecular weight polyethylene can result in a particularly smooth product, which can feel malleable in the mouth of a consumer.

A porous matrix additionally or alternatively can include one or more of the following polymer materials: acetals, acrylics such as polymethylmethacrylate and polyacrylonitrile, alkyds, polymer alloys, allyls such as diallyl phthalate and diallyl isophthalate, amines such as urea, formaldehyde, and melamine formaldehyde, cellulosics such as cellulose acetate, cellulose triacetate, cellulose nitrate, ethyl cellulose, cellulose acetate propionate, cellulose acetate butyrate, hydroxypropyl cellulose, cellophane and rayon, chlorinated polyether, coumarone-indene, epoxy, fluorocarbons such as PTFE, FEP, PFA, PCTFE, ECTFE, ETFE, PVDF, and PVF, furan, hydrocarbon resins, nitrile resins, polyaryl ether, polyaryl sulfone, phenol-aralkyl, phenolic, polyamide (nylon), poly(amide-imide), polyaryl ether, polycarbonate, polyesters such as aromatic polyesters, thermoplastic polyester, PBT, PTMT, PET and unsaturated polyesters such as SMC and BMC, polyimides such as thermoplastic polyimide and thermoset polyimide, polymethyl pentene, polyolefins such as LDPE, LLDPE, HDPE, and UHMWPE, polypropylene, inomers such as PD and poly allomers, polyphenylene oxide, polyphenylene sulfide, polyurethanes, poly p-xylylene, silicones such as silicone fluids and elastomers, rigid silicones, styrenes such as PS, ADS, SAN, styrene butadiene lattices, and styrene based polymers, sulfones such as polysulfone, polyether sulfone and polyphenyl sulfones, thermoplastic elastomers, and vinyls such as PVC, polyvinyl acetate, polyvinylidene chloride, polyvinyl alcohol, polyvinyl butyrate, polyvinyl formal, propylene-vinyl chloride copolymer, ethylvinyl acetate, and polyvinyl carbazole. In addition, the polymer or polymers from which a porous matrix is made can be colored, resulting in a colored smokeless tobacco product.

The tobacco contained in the articles provided herein can be granulated, powdered, flaked, shredded, cut (e.g., long cut tobacco), cured, aged, fermented, heat treated, pasteurized, encapsulated, or otherwise processed. Powdered, granulated, or flaked tobacco can be particularly useful. For example, tobacco can be in a granulated or powdered form so that it is sized to fit within the pores of a porous matrix. In some embodiments, some or all of the tobacco in a tobacco article can be processed from reconstituted tobacco. In other embodiments, the tobacco can be long cut tobacco having a length of about 0.25 inches to 1 inch and a width of between 0.005 inches to 0.05 inches. For example, tobacco can include between 35 cuts per inch. In some embodiments, long cut tobacco can be retained in a central portion of the article and a peripheral portion of the article can be substantially free of the long cut tobacco. In some embodiments, the article can include different combinations of different shaped of tobacco, optionally in different portions of the article. For example, an article having a central portion including long cut tobacco can also include powdered tobacco in other portions of the article, for example in peripheral portion of the article having a smaller average pore size than the central portion. Having an exterior portion of the article having a smaller average pore size can also prevent the migration of larger tobacco pieces in a central portion of the article from migrating into a users mouth.

Tobacco particles can be separated into different size ranges using methods known in the art, including mesh screening, for example. Further, a variety of sizes of tobacco particle can be used in the articles provided herein. For example, a tobacco article can comprise tobacco granules, powder, or flakes having an average tobacco particle diameter or width of about 20 microns to about 100 microns (e.g., about 20 microns, about 30 microns, about 40 microns, about 50 microns, about 60 microns, about 70 microns, about 80 microns, about 90 microns, or about 100 microns), or any range in between (e.g., about 20 microns to about 40 microns, about 40 microns to about 60 microns, or about 60 microns to about 100 microns). Tobacco particles having an average diameter or width of about 40 microns to about 60 microns can be particularly useful, as such particles can be readily obtained and can result in a tobacco product having a smooth, non-gritty texture. Where a grittier texture is desired, particles having an average diameter of about 60 microns to about 100 microns can be used. The size of tobacco particles can be modified based on a milling process (e.g., hammer milling).

Tobacco includes a part (e.g., leaves, flowers, and/or stems from a member of the genus *Nicotiana*. Exemplary species include *N. rustica, N. sylvestris, N. tomentosiformis*, and *N. tabacum* (e.g., varieties and/or cultivars designated LA B21, LN KY171, TI 1406, Basma, Galpao, Perique, Beinhart 1000-1, and Petico). Other species include *N. acaulis, N. acuminata, N. acuminata* var. *multiflora, N. africana, N. alata, N. amplexicaulis, N. arentsii, N. attenuata, N. benavidesii, N. benthamiana, N. bigelovii, N. bonariensis, N. cavicola, N. clevelandii, N. cordifolia, N. corymbosa, N. debneyi, N. excelsior, N. forgetiana, N. fragrans, N. glauca, N. glutinosa, N. goodspeedii, N. gossei, N. hybrid, N. ingulba, N. kawakamii, N. knightiana, N. langsdorffii, N. linearis, N. longiflora, N. maritima, N. megalosiphon, N. miersii, N. noctiflora, N. nudicaulis, N. obtusifolia, N. occidentalis, N. occidentalis* subsp. *hesperis, N. otophora, N. paniculata, N. pauciflora, N. petunioides, N. plumbaginifolia, N. quadrivalvis, N. raimondii, N. repanda, N. rosulata, N. rosulata* subsp. *ingulba, N. rotundifolia, N. setchellii, N. simulans, N. solanifolia, N. spegazzinii, N. stocktonii, N. suaveolens, N. thyrsiflora, N. tomentosa, N. trigonophylla, N. umbratica, N. undulata, N. velutina, N. wigandioides*, and *N. x sanderae*.

In some cases, the tobacco can be prepared from plants having less than 20 micrograms of 4,8,13-duvatriene-1,3-diols (DVTs; also referred to as 4,8,13-cembratriene-1,3-diols) per $cm^2$ of green leaf tissue. For example, tobacco particles can be prepared from the low DVT tobaccos described in U.S. Patent Publication No. 2008/0209586, which is incorporated herein by reference. Tobacco from such low-DVT varieties can exhibit improved flavor characteristics (e.g., in sensory panel evaluations) when compared to tobacco that does not have reduced levels of DVTs.

In some embodiments, the tobacco can include one or more components such as flavor extracts, flavor masking agents, bitterness receptor site blockers, receptor site enhancers, sweeteners, and additives such as chlorophyll, minerals, botanicals, or breath freshening agents. Some of these components are described, for example, in U.S. patent application Ser. Nos. 10/982,248 and 10/979,266, both of which are incorporated herein by reference in their entirety. Such components can be present in the tobacco as a powder, an oil, a powder in fine particulate form, or in encapsulated form.

In some embodiments, the tobacco can be processed to include flavor components prior to construction of a molded article. Such "primary" flavor components can be added, for example, by spraying tobacco with a flavor extract prior to combining the tobacco with a thermoplastic polymer and forming the tobacco article. In another example, flavor can be imparted to tobacco by combining solid or liquid flavor agents with a tobacco material and incubating under suitable conditions, as described, for example, in previously incorporated application Ser. No. 10/982,248. Alternatively or in addition, a tobacco article can be further processed to add one or more "secondary" flavor components via capillary action, injection, or other introduction means, such that the flavor components are added after construction of the article. In such embodiments, tobacco articles could be flavored in accordance with customer orders, resulting in increased control of inventory, for example. In other embodiments, flavor can be added after the article is formed by placing the article under a vacuum and subsequently filling the article with a flavor by placing a flavor in the vacuum chamber.

Flavor can be provided by synthesized flavors, flavor extracts, plant matter, or a combination thereof. Suitable flavors and flavor extracts include, without limitation, menthol, cinnamon, wintergreen, cherry, berry, peach, apple, spearmint, peppermint, bergamot, vanilla, coffee, a mint oil from species of the genus *Mentha*, or other desired flavors. Flavors can also be provided by plant matter, e.g., mint leaves, which typically are 10% flavor oils and 90% insoluble fiber. Suitable plant matter can be obtained from plants such as clove, cinnamon, herb, cherry, peach, apple, lavender, rose, vanilla, lemon, orange, coffee, or species of the genus *Mentha*. As further provided herein, flavor can also be provided by imitation, synthetic, or artificial flavor ingredients and blends containing such ingredients. Suitable sweeteners include, for example, sucralose, acesulfame potassium (Ace-K), aspartame, saccharine, cyclamates, lactose, sucrose, glucose, fructose, sorbitol, and mannitol. Liquid smoke or other heat activated flavorants also can be added to provide additional flavor.

Figure 9A:
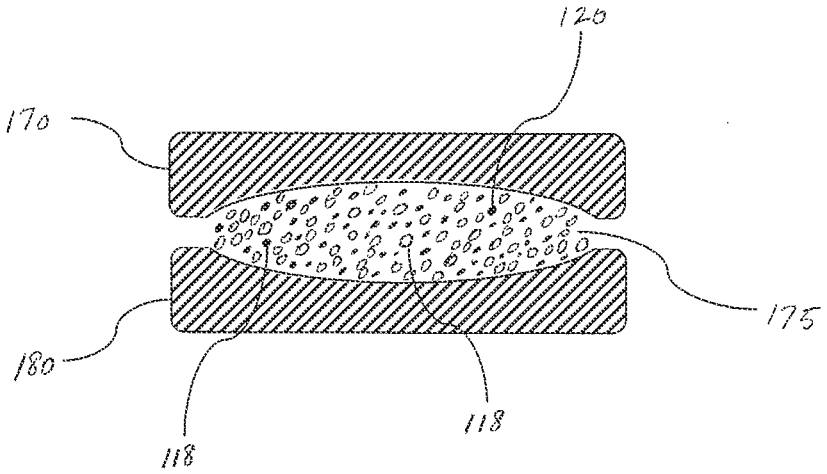
FIGS. 9A and 9B are cross-sectional views of a process for manufacturing an article according to some embodiments.
Figure 9B:
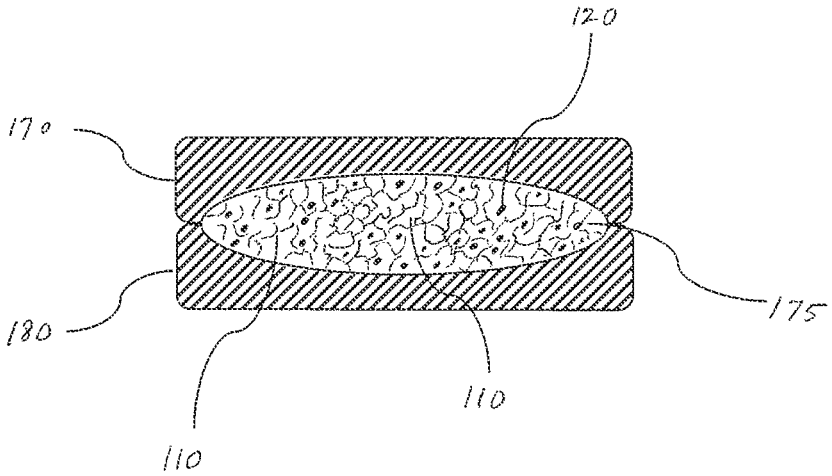

Tobacco (e.g., granulated, powdered, flaked tobacco particles, or long cut tobacco) can be combined with polymer material at a selected ratio, and the mixture can then be used in an integral molding process (as described, for example, in connection with FIGS. 9A and 9B). Typically, the products provided herein contain from about 30% to about 60% tobacco by weight, such that the ratio of tobacco:polymer ranges from about 30:70 to about 60:40 (e.g., about 40:60, about 45:55, or about 50:50). Alternatively, the tobacco products provided herein can contain from about 20% to about 80% tobacco by weight, such that the ratio of tobacco: polymer ranges from about 20:80 to about 70:30 (e.g., about 20:80, about 45:55, about 50:50, about 60:40, or about 70:30). A ratio of tobacco:polymer that is relatively low may result in a product that is perceived to be hard, while a ratio that is relatively high may result in loss of structural integrity, and can result in a product that is perceived to be soft.

The sizes of the tobacco particles and the polymer particles relative to one another can be varied. Typically, however, when relatively large tobacco particles (e.g., 60 microns to 100 microns in diameter, on average) are used, bigger polymer particles also must be used so that the resulting product has sufficient structural integrity. When relatively small tobacco particles (e.g., 40 microns to 60 microns in diameter, on average) are used, smaller polymer particles (e.g., 10 microns to 20 microns in diameter, on average) also can be used. The size of the tobacco and polymer particles can affect the texture of the resulting tobacco article. For example, smaller particles can result in a smoother product, while larger particles can give a rougher or grittier product. Thus, the tobacco articles provided herein can be manufactured to a variety of texture profiles.

The tobacco articles provided herein can have a variety of shapes (e.g., rectangular, square, spherical, cylindrical, rod shaped article being comfortable for placement in the mouth, or sheet-like). In some embodiments, a tobacco article can be adapted to be wholly received by an adult consumer. Such tobacco articles can be configured to nearly unlimited forms. For example, tobacco articles can be configured to resemble a tobacco pouch, and can have a generally elliptical shape, but other embodiments can have a pillow shape, a boat-like shape, a circular shape, a flat rectangular shape, or the like. Further, tobacco articles described herein can be formed or molded over a non-disintegratable substrate.

The article can also include accumulated granules of tobacco powder, sugars, starches, and/or flavors. Tobacco containing accumulated granules can be included in the article as the tobacco or along with other tobacco. For example, U.S. patent application Ser. No. 12/641,915, filed Dec. 18, 2009, entitled "Tobacco Granules and Method of Producing Tobacco Granules," which is hereby incorporated by reference, describes accumulated granules including tobacco particles. The granules can include a core and one or more layers surrounding the core that includes tobacco particles and a binder. In some embodiments, the accumulated granules can be coated with a polymer and used in the article as the polymer particles in the sintering process, either without additional solid polymer particles or with additional solid polymer particles making up the polymer matrix. In some embodiments, the accumulated granules can be fully encapsulated by the polymer. In other embodiments, the accumulated granules can include an incomplete coating that allows for tobacco, flavors, and/or other constituents to migrate though the network of pores in the article. During use, flavors and/or tobacco constituents of the accumulated granules can elute though the porous network of the article to be released into a users mouth. In some embodiments, mastication of the article can result in the release of flavorants from encapsulated accumulated granules within the sintered article. Accumulated granules, such as the tobacco granules described in U.S. patent application Ser. No. 12/641,915, can be coated with polymer according to known techniques in the art, including painting, sputtering, and drum coating processes.

Turning now to the figures, tobacco article 100 as depicted in FIG. 1 can include porous matrix 110, with tobacco 120 disposed in pores 112 of porous matrix 110 so that tobacco article 100 can provide, for example, tobacco to an adult consumer's mouth in the form of particles, liquid, or vapor. As described herein, providing tobacco can furnish tobacco satisfaction to the consumer.

Tobacco article 100 can be a noncombustible product, insofar as article 100 does not require ignition during use. Tobacco article 100 can provide tobacco to a consumer without combusting any part of tobacco article 100, and without igniting tobacco 120 inside article 100. Rather, the noncombusted tobacco can be provided to the consumer to provide tobacco satisfaction in the form of an experience associated with tobacco components, organoleptic components, and added flavor components that are released upon usage. Such organoleptic components can relate or contribute to the integrated sensory perception by the consumer that includes, for example, any combination of aroma, fragrance, flavor, taste, odor, mouth feel, or the like.

Tobacco article 100 can comprise a moldable polymer to permit molding into a desired shape. Tobacco 120 and porous matrix 110 can be integrally molded so that tobacco 120 is disposed in pores 112 when porous matrix 110 is formed. For example, polymer particles can be combined with tobacco particles, and the mixture can be subjected to a process such as sintering to generate tobacco article 100.

Porous matrix 110 can comprise a plurality of pores 112 that permit passage of air and/or liquid (e.g., water or saliva) from a first portion 114 to a second portion 116. In some embodiments, pores 112 can be randomly oriented to form a network of miniature passages through which air or liquid can pass over tobacco 120 disposed in porous matrix 110. In other embodiments, pores 112 can be manufactured to have a generally predetermined pore orientation, such as a plurality of pores that extend in a generally axial direction within porous matrix 110.

Figure 2:
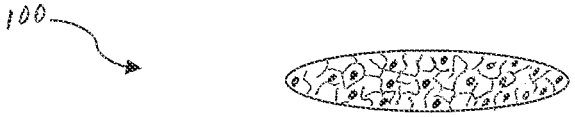
FIG. 2 is an end view of the tobacco article depicted in FIG. 1.
Figure 3:
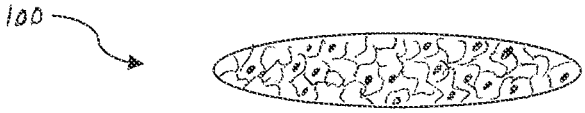
FIG. 3 is a side view of the tobacco article depicted in FIG. 1.

As shown in FIGS. 1-3, tobacco article 100 can essentially have a pillow-like rectangular shape, with rounded corners and edges that can provide a smooth outer surface.

Figure 4:
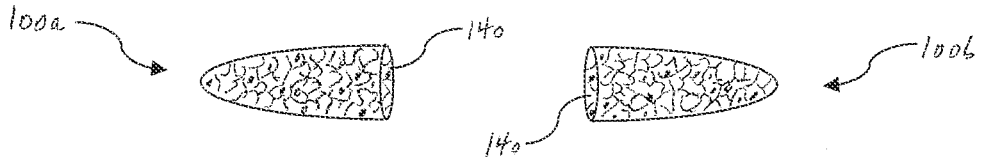
FIG. 4 is a side view of the tobacco article tobacco article depicted in FIG. 1 after it has been cleaved along axis "a."
Figure 5:
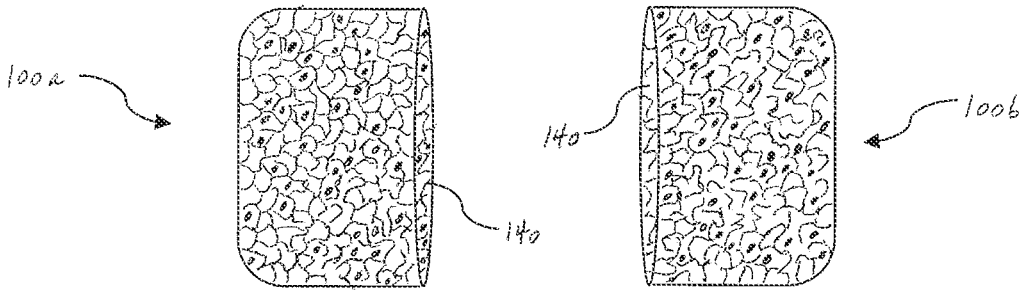
FIG. 5 is a top view of the tobacco article depicted in FIG. 1 after it has been cleaved along axis "a."

The thickness of a tobacco article can be constant or can vary. For example, FIGS. 2 and 3 depict end and side views, respectively, of tobacco article 100, which can have an increased thickness in the center as compared to the thickness at the periphery of the article. In some embodiments, a tobacco article can be molded (e.g., sintered) as described herein, and then can be further processed into the desired shape for the final product. For example, the tobacco article depicted in FIGS. 1-3 can be cut along line "a" to produce substantially "boat-shaped" tobacco articles 100*a* and 100*b*, as depicted in FIGS. 4 and 5. Depending on the sizes of the polymer particles from which article 100 is made, different regions of article 100 can have different porosities. For example, if the polymer particles in the central regions of article 100 are of larger average diameter than the particles about the periphery of article 100, the pores on cut surface 140 of articles 100*a* and 100*b* can be larger than the pores on the other surfaces of articles 100*a* and 100*b*.

Figure 6:
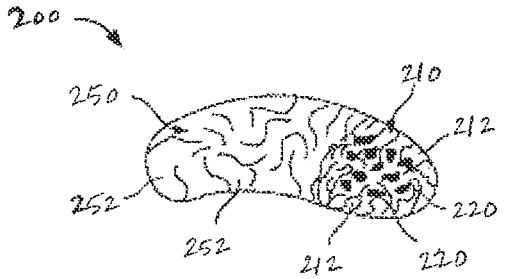
FIG. 6 is a cross-sectional view of a tobacco article according to some embodiments.

FIG. 6 depicts another embodiment of a tobacco article adapted to be wholly received by a consumer. Tobacco article 200 can have first porous matrix 210, tobacco particles 220, and second porous matrix 250 that, in some circumstances, can serve as a saliva reservoir. Saliva reservoir 250 can be a porous matrix that is integrally formed with first porous matrix 210, which contains tobacco 220. Saliva reservoir 250 can include pores 252 having a substantially greater pore size and pore volume than first porous matrix 210. For example, saliva reservoir 250 can be formed from polymer granules having a much larger size than the granules used to form first porous matrix 210. Thus, during a plastic sintering process, saliva reservoir 250 can become a porous matrix having pores 252 that are greater in size than the pores 212 of first porous matrix 210.

Figure 7:
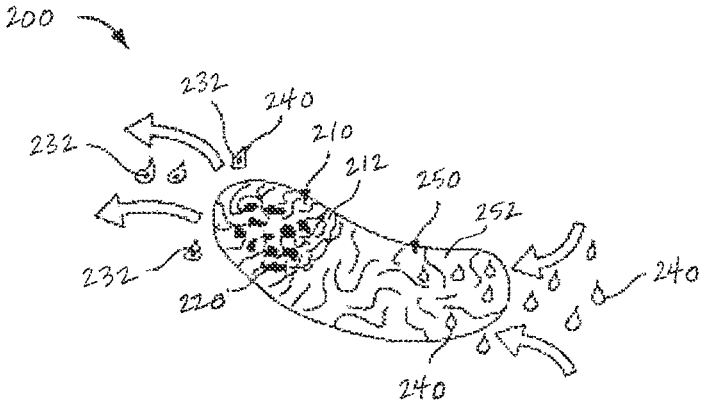
FIG. 7 is a cross-sectional view of a tobacco article according to some embodiments.

Tobacco articles 100 and 200 can be placed between the gums and the lip of a consumer, and can be exposed to the consumer's saliva. Referring to FIG. 7, for example, when first porous matrix 210 is exposed to a consumer's saliva 240, a portion of the saliva will be forced into pores 212. Saliva 240 can pass through the network of pores 212 so that tobacco components 232 (and, in some cases, fine tobacco particles) are introduced into the consumer's saliva. Accordingly, tobacco components 232 can mix with saliva 240. While tobacco is provided to the consumer, saliva reservoir 250 can absorb some portion of the saliva of the consumer, which can reduce the amount of spitting often associated with the use of smokeless tobacco products such as chewing tobacco or snuff. Accordingly, tobacco article 200 can provide tobacco satisfaction to the consumer without combusting tobacco article 200 or tobacco 220 disposed therein. Optionally, tobacco 220 can include one or more flavor agents or other components (as previously described), or flavor agent particles can be disposed in the pores 212 of porous matrix 210. In such circumstances, the flavor agents can be introduced into the liquid saliva so that a combination of flavor agents and tobacco components 232 are provided to the consumer.

When tobacco 220 in porous matrix 210 is exhausted or the consumer decides to remove tobacco article 200, the tobacco article can be discarded. Thus, tobacco article 200 can be discretely discarded with some portion of the consumer's saliva retained in saliva reservoir 250.

Figure 8:
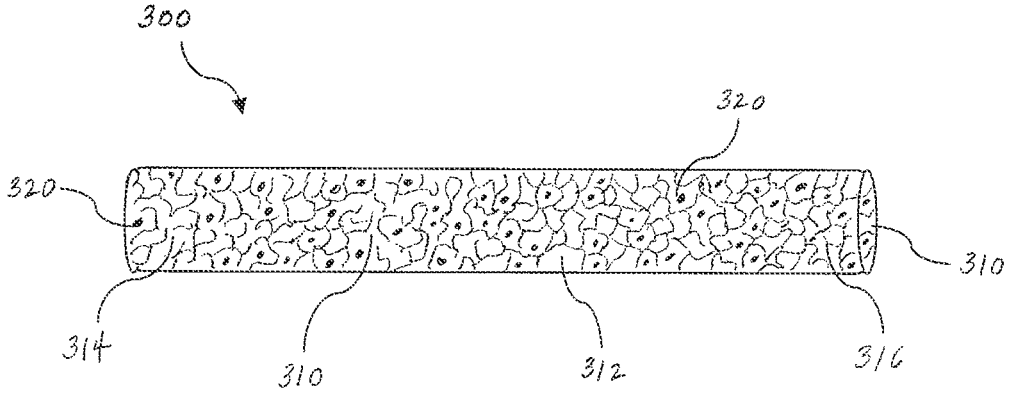
FIG. 8 is a cross-sectional view of a tobacco article according to some embodiments.

In some embodiments, a tobacco article can have a substantially cylindrical or rod-like shape, and can be configured to rest between the fingers of a consumer. For example, tobacco article 300, depicted in FIG. 8, can have an elongated cylindrical shape. Articles such as tobacco article 300 can be adapted to provide tobacco or tobacco components to a consumer in the form of a liquid, vapor or, in particular circumstances, a combination of vapor and fine particles or a combination of vapor and fine particles. In this embodiment, first and second portions 314 and 316 of porous matrix 310 can be exposed to the atmosphere, and a consumer can force air from first portion 314, through the network of pores 312, and over tobacco 320 disposed therein, and out from second portion 316. For example, a consumer can create a negative pressure on tobacco article 300 proximal to second portion 316 so that the air is drawn through porous matrix 310 and into the consumer. As the air passes through porous matrix 310, tobacco components can be introduced into the air and be provided to the consumer. The tobacco components (e.g., flavors, aromas, or the like) can be in the form of vapor that transfers from tobacco 320 to the air that is passed through porous matrix 310. Accordingly, tobacco article 300 can provide tobacco satisfaction in the form of the experience associated with tobacco organoleptic components and added flavor components that are released. Such organoleptic components can relate or contribute to the integrated sensory perception by the consumer that includes, for example, any combination of aroma, fragrance, flavor, taste, odor, mouth feel, or the like. Also as described above, tobacco 320 can include one or more flavor agents, or flavor agent particles can be disposed in pores 312 of porous matrix 310. In these circumstances, the flavor agents can be introduced into the air so that a combination of flavor agents and tobacco are provided to the consumer.

In some embodiments, tobacco 320 can be arranged in a manner that permits tobacco article 300 to provide tobacco to a consumer in the form of vapor and fine particles. For example, tobacco 320 in porous matrix 310 can be finely granulated so that fine tobacco particles are capable of passing through the network of pores 312 in porous matrix 310. In such circumstances, a consumer can apply negative pressure on tobacco article 300 proximal to second portion 316 so that the air is drawn through porous matrix 310 by the consumer. As the air passes through porous matrix 310, the fine tobacco particles and tobacco flavor can be provided to the consumer as a combination of vapor and fine particles. Again, tobacco article 300 can provide tobacco satisfaction to the consumer without combusting tobacco article 300 or tobacco 320 disposed therein.

FIGS. 9A and 9B depict an exemplary plastic sintering process that can be used to form a tobacco article as provided herein. Such a plastic sintering process can include controlled application of heat using one of a variety of heating techniques, some of which are described, for example, in U.S. Pat. No. 4,375,441, which is incorporated herein by reference in its entirety. It should be understood that plastic sintering is only one process of several possible processes that can be used to form the porous matrix of the tobacco articles described herein.

Referring now to FIGS. 9A and 9B, some embodiments of a tobacco article can be integrally formed in a molding process. Tobacco 120 can be combined with polymer particles 118 during the molding process so that tobacco 120 is integrally molded with porous matrix 110. As shown in FIG. 9A, the formation process can utilize first and second mold pieces 170 and 180 that can fit together to define internal cavity 175. Internal cavity 175 can include machined surfaces that at least partially define the desired outer shape of a tobacco article. Tobacco 120 and polymer particles 118 can be placed in internal cavity 175. In some embodiments, different sizes of polymer particles 118 can be placed into internal cavity 175 to give a tobacco article having pores of different sizes. For example, the polymer particles can be arranged such that the particles along the outer portions of cavity 175 are of a smaller average diameter than the polymer particles within a central portion of cavity 175. After a sintering process, the resulting tobacco article can have a network of pores that are larger within a central portion than at the peripheral portions. In some embodiments, different types of polymer particles can be placed within cavity 175 such that, for example, the particles along the outer portions of cavity 175 are of a different type of material than the particles within a central portion of cavity 175. For example, the central granules can comprise a plastic polymer material, such as polyethylene or polypropylene. Further, porous matrix 110 can generally comprise a polymer material that is water soluble or water insoluble. It should be understood that a variety of material specifications (e.g., granule size and molecular weight, granule size distribution, material type, tobacco particle size, tobacco particle distribution, and the ratio of polymer granules to tobacco particle) and also a variety of process parameters (e.g., temperature, heat exposure time, and pressure) can be used to provide porous matrix 110 (FIG. 9B) having advantageous characteristics. It should be understood that some portion of the central granules can melt and merge with outer granules along a transition zone near the outer granules.

Tobacco 120 can be intermixed with particles 118 during a plastic sintering process so that at least a portion of tobacco 120 is disposed in pores 112 after particles 118 have formed porous matrix 110. It should be understood that particles 118 and tobacco 120 are not necessarily drawn to scale, and the sizes of polymer and tobacco particles in any of the figures presented herein can be exaggerated for purposes of illustration.

Referring to FIG. 9B, when particles 118 and tobacco 120 are arranged in mold cavity 175, mold pieces 170 and 180 can apply pressure while particles 118 are heated for a controlled period of time. Such pressure and heat can cause a tobacco article to form into its desired shape while the central granules are controllably melted for a limited period of time. While it is not intended that this embodiment be limited by any theory by which it achieves its advantageous result, it is believed that, during this plastic sintering process, the outer granules can melt at a faster rate to form a substantially continuous layer along the outer surface of a tobacco article, while the central granules melt at a slower rate (e.g., the granule surfaces can partially heat to bond with adjacent granules even though some of the granules do not completely melt). The number of cycles, cycle times, and temperature of a plastic sintering process can be varied as desired to give particular flavor characteristics (e.g., roasted and/or toasted tobacco flavors) to a tobacco article.

After sintering, a tobacco article can be further processed by, for example, adding one or more flavoring agents or colorants. Such agents can be added using a number of methods (e.g., capillary action, injection, spraying, or under vacuum). The outer surfaces of an article also can be coated with a colorant and/or a flavoring agent via a "high coater" technique, which can result in an outer coating similar to that on "gel capsule" pills. Such coatings can dissolve away when placed into a consumer's mouth, after which tobacco can be provided to the consumer. In some embodiments, a tobacco article can be manufactured from central polymer granules and outer polymer granules, wherein the central polymer granules can comprise a different polymer material, can have a larger average size, or both, as compared to the outer granules. This can facilitate the slower melting rate of granules within the interior of the tobacco article. Because tobacco was mixed with the central granules, at least a portion of the tobacco can be disposed in the pores after the granules have formed a porous matrix. It should be understood that some characteristics of the pores (e.g., average pore size, average pore volume, or the like) can be selected by varying, for example, the size of granule materials used to form the porous matrix, the temperature at which the granules are heated, the amount of time at which the granules are heated, and the pressure used in a molding process.

In some embodiments, the central granules can comprise the same copolymer material (e.g., BAREX™ from Innovene LLC of Chicago, Ill.) as the outer granules, and the central granules can have a larger average size than the outer granules. It should be understood that, in some circumstances, the central granules and the outer granules can have similar average sizes.

Figure 10:
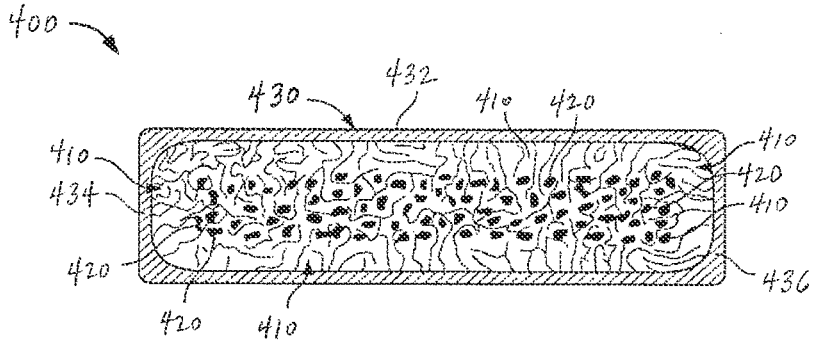
FIG. 10 is a cross-sectional view of a tobacco article according to some embodiments.

In some embodiments, a tobacco article can be wrapped in paper or reconstituted tobacco sheet after formation thereof. In some cases, a tobacco article can have an outer layer of a plastic polymer. As depicted in FIG. 10, for example, tobacco article 400 can have porous matrix 410, tobacco 420, and outer layer 430. Outer layer 430 and porous matrix 410 can include the same moldable plastic material or different moldable plastic materials. Outer layer 430 can fully or partially surround porous matrix 410 and tobacco 420 disposed therein. In some cases, outer layer 430 can comprise a generally continuous layer of material that is impermeable to the migration of tobacco components inside article 400. In some embodiments, outer layer 430 can comprise a polymer material that can be formed to provide the substantially continuous layer.

A number of materials are suitable for outer layer 430. For example, outer layer 430 can comprise a copolymer of acrylonitrile and methyl acrylate (or an equivalent resin) known to provide barrier characteristics that inhibit the migration of tobacco components, including volatile tobacco components. Such a copolymer of acrylonitrile and methyl acrylate is available under the trade name BAREX™. Other polymer materials, such as polyethylene naphthalate (PEN), polytrimethylene naphthalate (PTN), or polyester-based liquid crystal polymers (LCP), alternatively can be employed to provide barrier characteristics that inhibit migration of tobacco components.

In some embodiments, outer layer 430 can be formed to fully surround porous matrix 410 within a longitudinally extending surface 432 and first and second cap surfaces 434 and 436. Alternatively, article 400 can be constructed in such a way that first and second cap surfaces 434 and 436 are not created during formation. Either configuration can inhibit tobacco 420 or tobacco components (e.g., flavors, aromas, alkaloids, or the like) from migrating away from porous matrix 410 before the ordinary use of article 400 has commenced. Tobacco article 400 can be manufactured using a process such as the sintering process described above. Such a process can form porous matrix 410 that is at least partially surrounded by outer layer 430.

Figure 11:
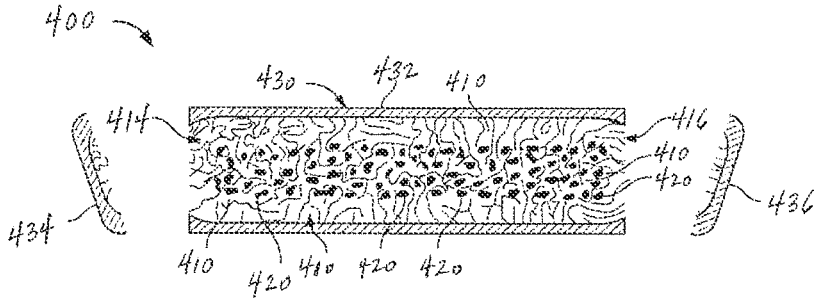
FIG. 11 is a cross-sectional view of a tobacco article according to some embodiments.

Referring now to FIG. 11, some embodiments of tobacco article 400 can be configured to expose first and second portions 414 and 416 of porous matrix 410. For example, in embodiments in which outer layer 430 includes first and second cap surfaces 434 and 436, at least a portion of each cap surface 434 or 436 can be cut, punctured, or otherwise removed to expose first and second portions 414 and 416 of porous matrix 410. This removal process can be performed during the manufacturing or packaging of tobacco article 400 (e.g., cutting cap surfaces 434 and 436 to provide a uniform length of the article and then wrapping one or more articles 400 in an impermeable package), or can be performed by the consumer immediately before using tobacco article 400. In some embodiments, tobacco article 400 can be supplied to the consumer in a package that includes a cutter mechanism or a puncture mechanism to facilitate the use of the tobacco article. When cap surfaces 434 and 436 are removed, longitudinally extending surface 432 of outer layer 430 can remain intact so as to substantially surround the outer radial area of porous matrix 410. First and second portions 414 and 416 of porous matrix 410 can be exposed to the atmosphere so that air can be passed through the network of pores 412 and over tobacco 420 disposed therein. As further provided herein, some embodiments of tobacco article 400 can be configured to expose first and second portions 414 and 416 of porous matrix 410 during manufacturing, thus eliminating the need to cut cap surfaces 434 and 436.

Figure 12:
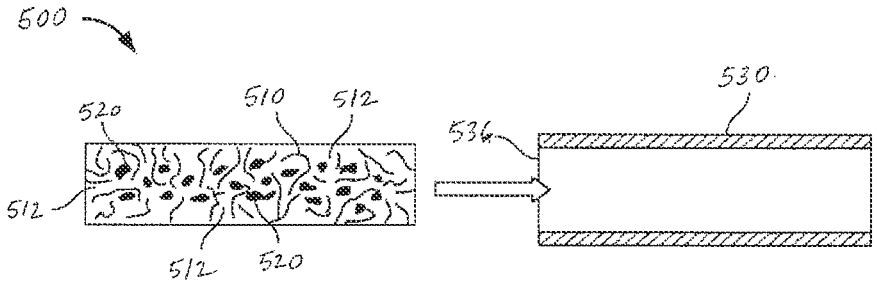
FIG. 12 is a cross-sectional view of a tobacco article according to some embodiments.

In some embodiments, a tobacco article can have a porous matrix that is formed separately from an outer shell. Referring to FIG. 12, for example, tobacco article 500 can include porous matrix 510 that is formed separately from outer shell 530. Porous matrix 510 can be formed using a plastic sintering process (e.g., as described in connection with FIGS. 9A and 9B). Alternatively, porous matrix 510 can be formed using a different process in which porous matrix 510 comprises a porous glass or ceramic material having tobacco 520 disposed in pores 512. Depending on the formation process of porous matrix 510, tobacco 520 can be integrally molded with porous matrix 510 so that tobacco 520 is disposed in pores 512. Porous matrix 510 can be formed or otherwise configured to mate with a separate shell 530. In such embodiments, separate shell 530 can comprise a tubular configuration having open end 536 to receive porous matrix 510. As such, porous matrix 510 can be slid into and engage separate shell 530.

As described above, outer shell 530 can comprise a continuous layer of material that is impermeable to migration of tobacco and tobacco components, such as BAREX™ In embodiments in which porous matrix 510 should be sealed until being used by a consumer, separate shell 530 can comprise a tube of BAREX™ that is sealed at the open ends thereof after porous matrix 510 is inserted into shell 530. For example, the open ends of tubular shell 530 can be heat sealed using BAREX™ cap walls. In another example, the open ends of tubular shell 530 can be heat sealed using a heat pinching process.

Figure 13:
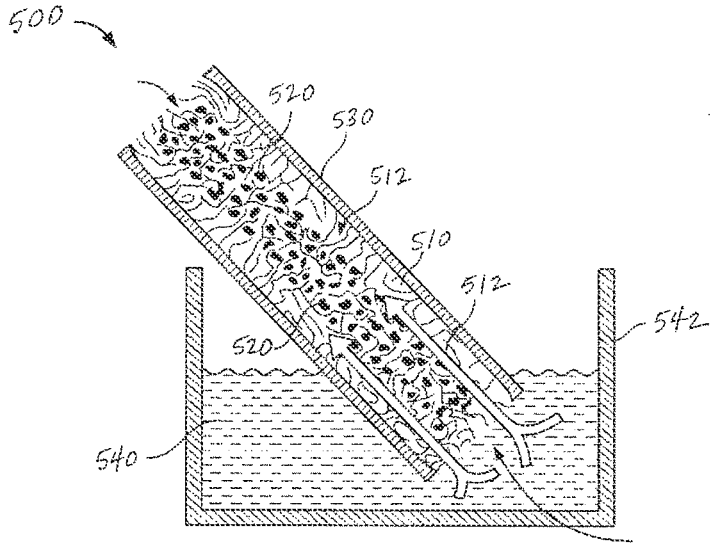
FIG. 13 is a cross-sectional view of a tobacco article according to some embodiments.

As shown in FIG. 13, at least a portion of porous matrix 510 can be temporarily exposed to liquid 540 so that liquid 540 is introduced into pores 512. For example, liquid 540 can progress into pores 512 of porous matrix 510 through capillary action, so that some portion of the liquid remains in porous matrix 510 even after tobacco article 500 is removed from liquid container 542. In some embodiments, liquid 540 can include water.

Figure 14:
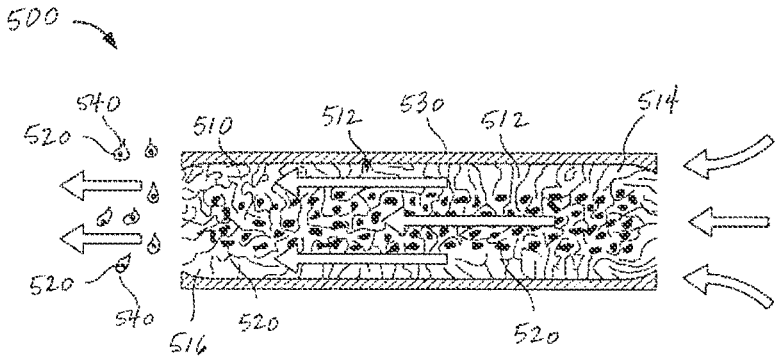
FIG. 14 is a cross-sectional view of a tobacco article according to some embodiments.

As shown in FIG. 14, first and second portions 514 and 516 of porous matrix 510 can be exposed to the atmosphere, and a consumer can force air from first portion 514 and into the network of pores 512. The consumer's vacuum action can cause liquid 540 that was previously introduced into first portion 514 of porous matrix 510 to pass over tobacco 520 disposed in the pores. As such, liquid 540 can be drawn through porous matrix 510 and to the consumer. As liquid 540 passes through porous matrix 510, tobacco 520 can be introduced into liquid 540 so that tobacco satisfaction is experienced by the consumer. Tobacco 520 can be mixed with liquid 540. Accordingly, tobacco article 500 can provide tobacco satisfaction to the consumer without combusting tobacco article 500 or tobacco 520 disposed therein. Optionally, tobacco 520 can include one or more flavor agents or other components (as described herein), or flavor agent particles can be disposed in pores 512 of porous matrix 510. In such circumstances, the flavor agents can be introduced into liquid 540 so that a combination of flavor agents and tobacco 520 are experienced by the consumer.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A tobacco article, comprising:

a porous matrix having a network of pores disposed therein; and tobacco disposed in the pores of the porous matrix, so that when a fluid is passed through the porous matrix, at least one of noncombusted tobacco or a noncombusted tobacco component is introduced into the fluid, wherein the tobacco is integrally molded with the porous matrix, wherein the article comprises a central portion having a first average pore size and a peripheral portion having a second average pore size, the first average pore size being larger than the second average pore size.

2. The tobacco article of claim 1, wherein the tobacco is integrally molded with the porous matrix during a plastic sintering process.

3. The tobacco article of claim 2, wherein the thermoplastic polymer is ultra-high molecular weight polyethylene.

4. The tobacco article of claim 2, wherein thermoplastic polymer particles have an average diameter between about 10 microns and about 100 microns are sintered to form the porous matrix.

5. The tobacco article of claim 2, wherein the tobacco article comprises a ratio of tobacco to polymer of 30:70 to 50:50 by weight.

6. The tobacco article of claim 5, wherein the tobacco comprises granulated or powdered tobacco particles having an average diameter between about 20 microns and about 100 microns.

7. The tobacco article of claim 5, wherein the tobacco comprises granulated or powdered tobacco particles having an average diameter between about 40 microns and about 60 microns.

8. The tobacco article of claim 1, wherein the porous matrix comprises particles of a thermoplastic polymer.

9. The tobacco article of claim 1, wherein the tobacco comprises at least one of shredded tobacco, cut tobacco, granulated tobacco, or powdered tobacco.

10. The tobacco article of claim 1, wherein the tobacco article further comprises one or more flavor components.

11. The tobacco article of claim 1, wherein the tobacco article is adapted to be wholly received by a mouth of an adult consumer.

12. The tobacco article of claim 1, wherein the tobacco article has a shelf life of at least 30 weeks.

13. A tobacco article, comprising:

a porous matrix having a network of pores disposed therein; and tobacco disposed in the pores of the porous matrix, so that when a fluid is passed through the porous matrix, at least one of noncombusted tobacco or a noncombusted tobacco component is introduced into the fluid;

wherein the tobacco is integrally molded with the porous matrix during a plastic sintering process, wherein thermoplastic polymer particles have an average diameter between about 10 microns and about 20 microns are sintered to form the porous matrix.

14. The tobacco article of claim 13, wherein the article comprises a central portion having a first average pore size and a peripheral portion having a second average pore size, the first average pore size being larger than the second average pore size.

* * * * *